US005648640A

United States Patent [19]

Osborn

[11] Patent Number: 5,648,640

[45] Date of Patent: Jul. 15, 1997

[54] RE-INSULATION OF CONDUCTOR JUNCTIONS OF PRIMARY CONDUCTORS

[75] Inventor: William G. Osborn, Stamford, Conn.

[73] Assignee: Framatome Connectors USA, Inc., Norwalk, Conn.

[21] Appl. No.: 507,627

[22] Filed: Jul. 26, 1995

[51] Int. Cl.[6] ..... H01R 4/70

[52] U.S. Cl. ..... 174/84 R; 174/74 R

[58] Field of Search ..... 174/74 R, 74 A, 174/75 R, 72 R, 84 R, 92

[56] References Cited

U.S. PATENT DOCUMENTS

| | | | |
|---|---|---|---|
| 4,107,451 | 8/1978 | Smith, Jr. et al. | 174/84 R |
| 4,203,000 | 5/1980 | Muller | 174/92 |
| 4,341,921 | 7/1982 | Simpson | 174/84 R |
| 4,625,073 | 11/1986 | Breesch et al. | 174/72 R |
| 4,885,429 | 12/1989 | Schnittker | 174/65 SS X |
| 5,278,352 | 1/1994 | Schade | 174/65 SS X |

*Primary Examiner*—Kristine L. Kincaid
*Assistant Examiner*—Chau N. Nguyen
*Attorney, Agent, or Firm*—Patrick J. Walsh

[57] ABSTRACT

An arrangement for insulating junctions of three or more conductors utilizing standard connectors for joining conductors having different types of insulation and/or different sizes. The junction is enclosed in a cage formed of wire, wire and sheet metal, sheet plastic, or molded plastic. The cage material is supplied in sheet form and is cut to appropriate size for a particular junction to form an armature for supporting insulating material. A hoop may be used to support the cage. Insulation covers the cage and connectors.

5 Claims, 4 Drawing Sheets

RE-INSULATION OF CONDUCTOR JUNCTIONS OF PRIMARY CONDUCTORS

BACKGROUND OF THE INVENTION

The present invention relates to formation of conductor junctions in primary conductors of an electrical distribution system of 15,000 volts (15 KV) or higher using standard compression terminals for linking the conductors. In particular, the invention relates to re-insulation of the formed junctions.

Primary conductors provide the main power supply in urban electrical distribution systems wherein public utility crews pull the primary conductors through underground duct systems in lengths sufficient only to reach between vaults spaced a block apart in downtown business districts with the cable being spliced in each vault. In many vaults, a primary service must be taken off by means of a three conductor junction to supply power to a customer's building adjacent the vault.

In most cases, the three conductors are not the same size and therefore a special Y-shaped connector has to be made. Y-shaped connectors in both copper and aluminum have been used for many years, however, the available quantity of such connectors is always small, and the customer's requirements must be known well in advance to allow sufficient time to make-to-order the required Y-shaped connectors.

Primary conductors in general, are supplied having one or the other of two types of insulation, either solid dielectric (e.g., high density polyethylene) or "paper and lead" in which the cable intersticies are filled with oil. When the two types of cables are to be joined, as is often the case, the migration of oil from the "paper and lead" cable into the solid dielectric cable must be prevented. For a two conductor splice of same size, different type (i.e., one oil filled, one not) oil stop connectors are available, for example Burndy Corporation type YSP-T "oil stop" HYSPLICE connectors.

Improvement is needed in the art of primary conductor splices taking into account the different insulation types and sizes of conductors particularly in cases where three or more conductors form a junction. The use of standard connector terminals has always been a possibility; however, there has never been found a simple, expedient way to apply the insulating materials over that area of the junction where the terminal pads of standard connectors are bolted together. This invention solves that problem.

SUMMARY OF THE INVENTION

The present invention comprises a technique for reinsulating junctions of three or more conductors utilizing standard connectors for joining conductors having different types of insulation and/or different sizes. In accordance with the invention, the junction is enclosed in a cage formed of wire, wire and sheet metal, sheet plastic, or molded plastic. The cage material is supplied in sheet form and is cut to appropriate size for a particular junction. The cage material when flat comprises an elongate bendable transverse strip defining a header for supporting a plurality of longitudinally extending fingers. In use, the cage is formed by wrapping the transverse strip about the connectors on one side of a junction with the fingers extending along the axis of the junction, across the bolted connector joint, and terminating with the tips of the fingers laying circumferentially about the connector connectors on the other side of the junction. In this position, the cage forms a smooth armature for supporting the insulating materials as they are applied across the junction.

Where tape is applied in many layers as an insulating material, the attendant radial compressive force induced as the insulating tape is applied tends to reduce the size of the protective armature formed by the cage. A supporting hoop attached to the connector bolts provides support for the cage against the radial compressive force.

OBJECTS OF THE INVENTION

It is an object of the invention to provide a technique for accomplishing the formation and insulation of junctions of three or more conductors with standard connectors.

It is an object of the invention to provide an armature in the form of a flexible cage for formation and insulation of junctions of three or more conductors with standard connectors.

It is a further object of the invention to provide flexible cage for formation and insulation of junctions of three or more conductors with standard connectors in cases where the conductors may be different in size or different in type of insulation.

It is a further object of the invention to provide flexible cage for forming insulated junctions of primary conductors whereby the cage can be readily formed and installed by a lineman operating in an underground vault of an urban electrical distribution system.

It is an object of the invention to provide an armature in the form of a flexible cage together with a supporting hoop for formation and insulation of junctions of three or more conductors with standard connectors.

Other and further objects of the invention will occur to one skilled in the art with an understanding of the following detailed description of the invention or upon employment of the invention in practice.

DESCRIPTION OF THE DRAWING

A preferred embodiment of the invention has been chosen for purposes of illustrating the construction and operation of the invention and is shown in the accompanying drawing in which.

DETAILED DESCRIPTION OF THE INVENTION

Figure 5:
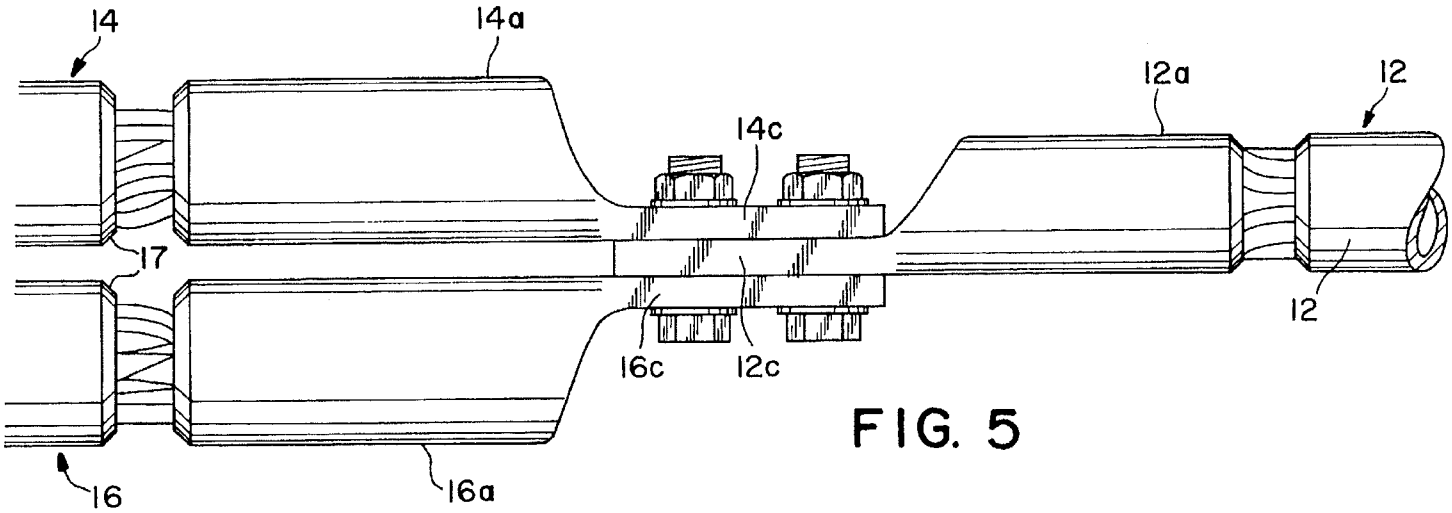
FIG. 5 is a side elevation of an uninsulated junction of conductors prior to application of cage and insulation according to the invention.

Referring to the drawing, the invention comprises means including cages 10 (FIGS. 1–3) for forming insulated junctions of three or more conductors utilizing standard connectors. In FIG. 5 of the drawing a single conductor 12 is attached to a pair of conductors 14, 16 using standard connectors 12*a*, 14*a*, and 16*a* bolted together at connector pads 12*c*, 14*c*, and 16*c*. The conductors may be the same size and type or different sizes and types, i.e., with "paper and lead" or solid dielectric insulation 17.

In accordance with the invention, the junction is enclosed in a cage formed of wire, wire and sheet metal, sheet plastic, or molded plastic.

Figure 1:
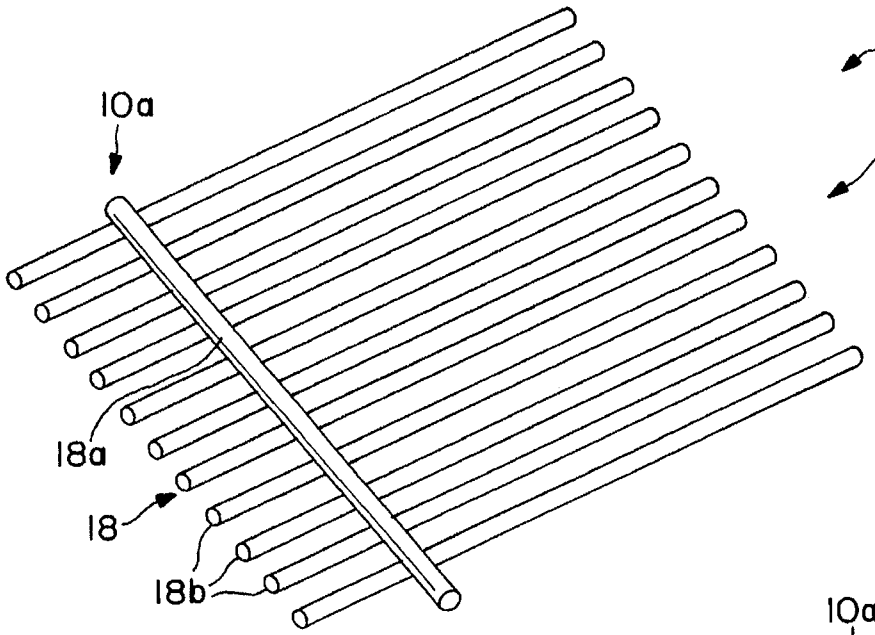
FIG. 1 is a perspective view of cage blank of all wire for use in forming an insulated connection according to the invention.
Figure 2:
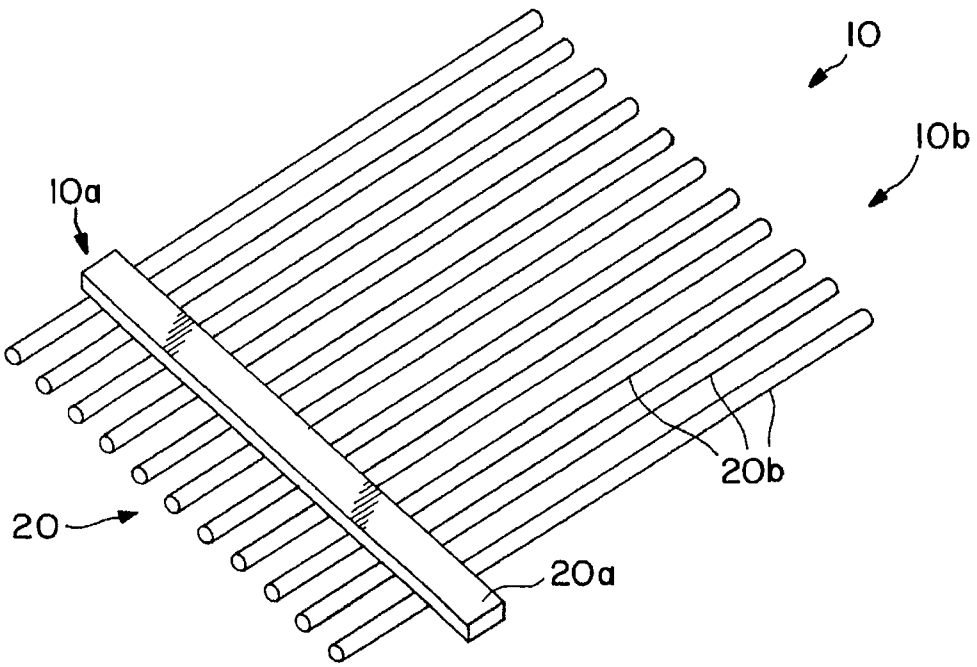
FIG. 2 is a perspective view of cage blank of sheet metal and wire for use in forming an insulated connection according to the invention.
Figure 3:
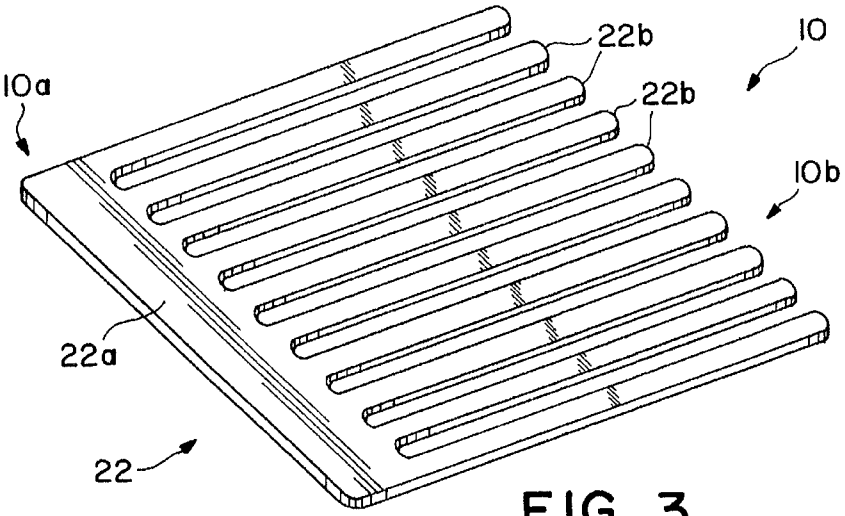
FIG. 3 is a perspective view of cage blank of stamped or molded plastic for use in forming an insulated connection according to the invention.

The cage material is supplied in sheet form and is cut to appropriate size for a particular junction. The cage material when flat comprises an elongate bendable transverse strip 10*a* defining a header for supporting a plurality of longitudinally extending fingers 10*b*. FIGS. 1–3 illustrate several kinds of cage blanks. FIG. 1 is an all wire blank 18 including a transverse wire header 18*a* with a plurality of wire rods 18*b* extending finger-like at right angles from the header. FIG. 2 illustrates a cage 20 having a sheet metal strip 20*a* as the header welded to a set of wire rods 20*b* defining members of a cage. FIG. 3 is a cage 22 formed of molded or stamped plastic with fingers 22*b* projecting longitudinally from a transverse header 22*a*.

Figure 4:
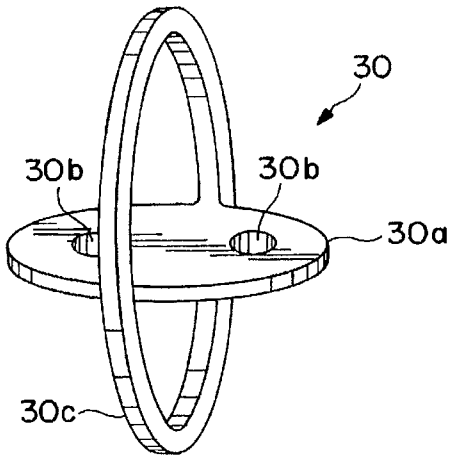
FIG. 4 is a side elevational view of a supporting hoop for the cage according to the invention.
Figure 6:
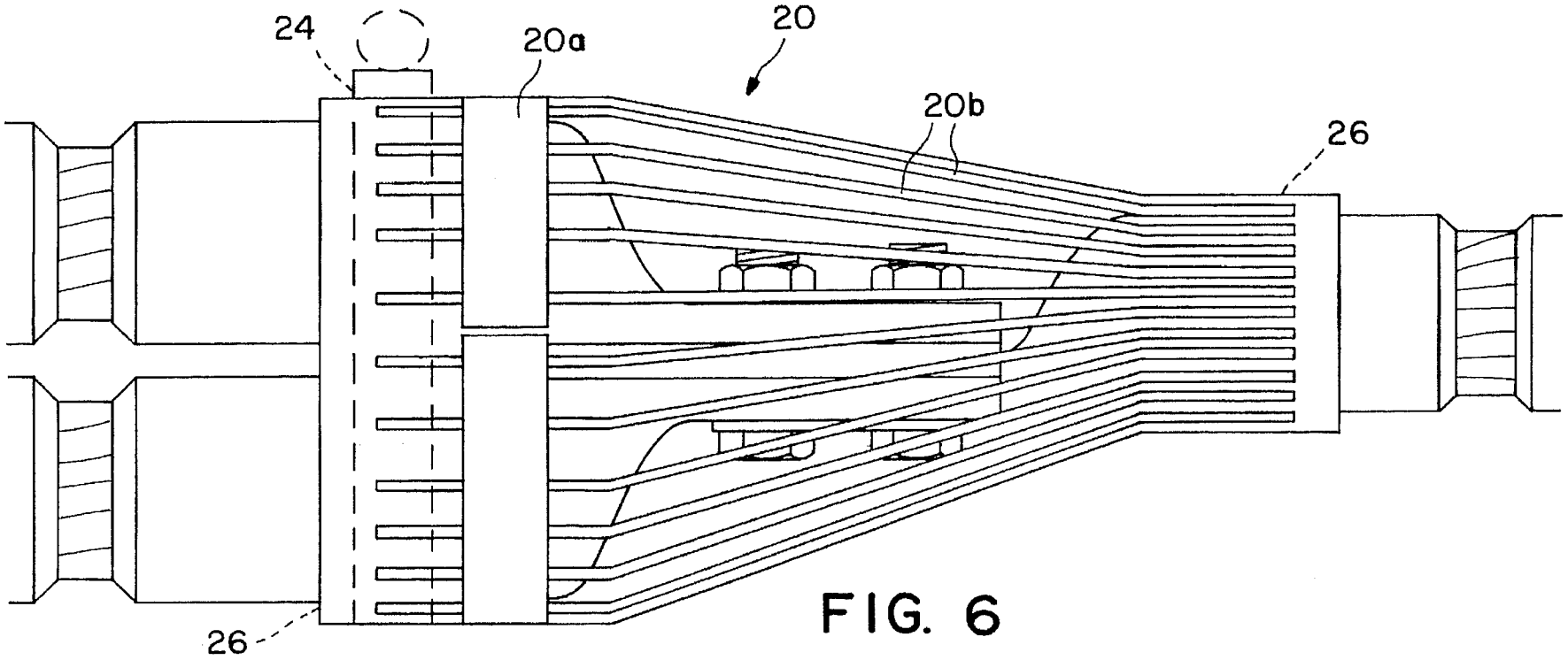
FIG. 6 is a side elevation of an uninsulated junction of conductors after application of a cage and prior to application of insulation according to the invention.

In use, a cage blank is trimmed, if necessary to correct length of header for encircling the larger side of the junction, i.e., connectors 14*a* and 16*a*. The cage is formed by wrapping the transverse strip about the connectors on one side of a junction with the fingers extending along the axis of the junction, across the bolted connector joint, and terminating with the tips of the fingers laying circumferentially about the connector 12*a* or connectors on the other side of the junction. As an aid in assembly, the header end of the cage may be temporarily held in place by means of a pipe clamp 24 (FIG. 6) and the tip end by a wrap or two of insulating tape. The lineman covers the cage with insulation 26 such as multiple layers of insulating tape or a shrink wrap insulation after which the pipe clamp is removed. Applied in this way, the cage forms a smooth armature for supporting the insulating materials as they are applied across the junction.

Where tape is applied in many layers as an insulating material, the attendant radial compressive force induced as the insulating tape is applied tends to reduce the size of the protective armature formed by the cage. A supporting hoop 30 (FIG. 4) attached to the connector bolts as shown FIG. 7 provides support for the cage against the radial compressive force.

The hoop is of unitary construction and of a conducting material the same as the connectors. The hoop has a center plate 30*a* approximately the size of a connector pad, with holes 30*b* aligned for accepting the connection bolts. An outer ring 30*c* projects from the plate and encircles the entire connection with a ring ends abutting adjacent the plate projection.

Figure 7:
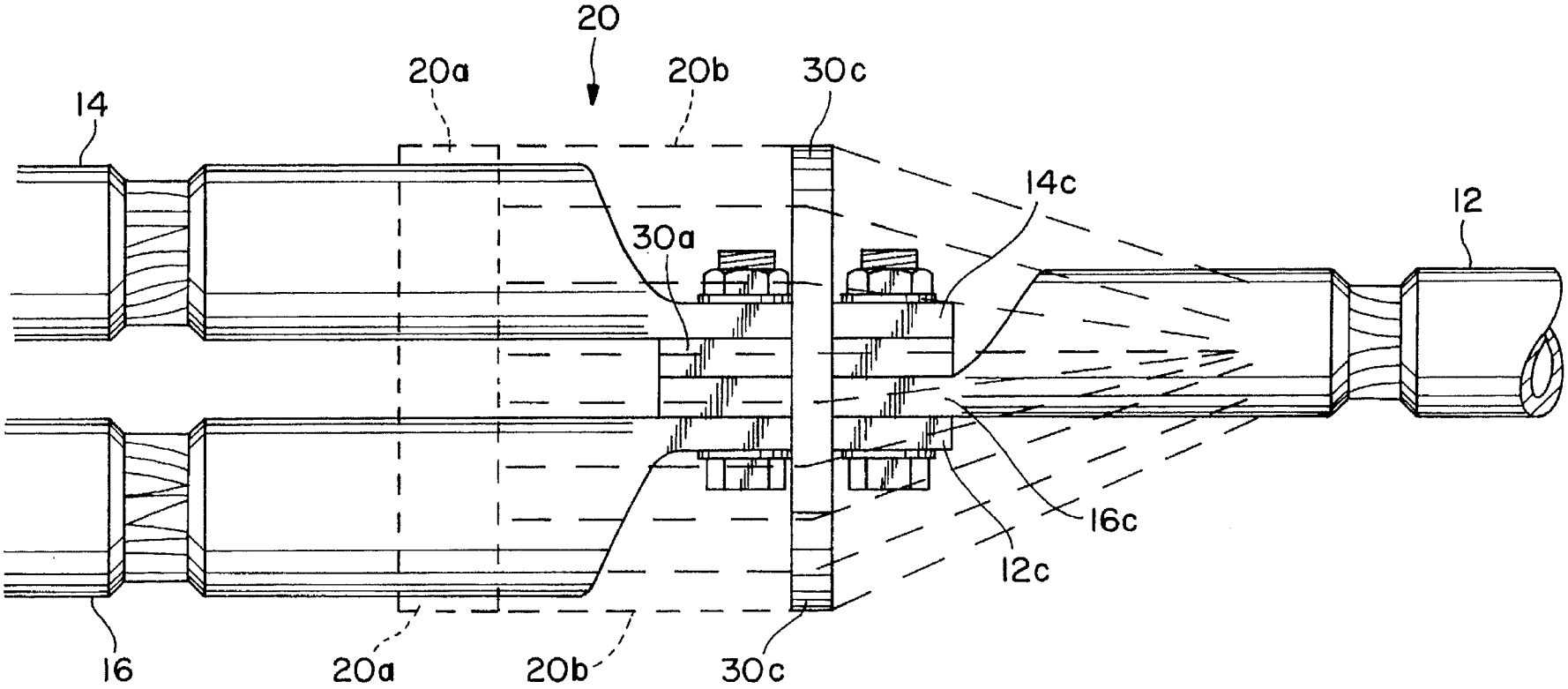
FIG. 7 is a side elevation of an uninsulated junction of conductors after application of a cage and hoop and prior to application of insulation according to the invention.

When a cage header 22*a* encircles connectors 14, 16 as shown in FIG. 7, the hoop lies under the finger members 22*b* of the cage supporting the fingers against the radially inward compressive force as the insulation is being applied.

I claim:

1. A junction of at least three conductors comprising a connector joined to each of said conductors with the connectors being secured to each other and with the joined conductors having opposite sides lying along a common axis, a cage having a transverse header and a plurality of longitudinally extending fingers, the cage being formed by wrapping the transverse header about the connectors on one side of the junction with the fingers extending along the axis of the junction to the other side, across the junction, and terminating with tips of the fingers laying circumferentially about the connectors or conductors on the other side of the junction, the cage forming a smooth armature for supporting insulating materials applied across the junction, and insulation applied to the cage for insulating the junction.

2. A junction of at least three conductors comprising a connector joined to each of said conductors with the connectors being secured to each other and with the joined conductors having opposite sides lying along a common axis, a cage having a transverse header and a plurality of longitudinally extending fingers, the cage being formed by wrapping the transverse header about the connectors on one side of the junction with the fingers extending along the axis of the junction to the other side, across the junction, and terminating with tips of the fingers laying circumferentially about the connectors or conductors on the other side of the junction, a hoop having a central plate affixed to the connectors and a ring affixed to the plate for encircling the connectors inside the cage fingers, the cage and hoop forming a smooth armature for supporting insulating materials applied across the junction.

3. A junction as defined in claim 1 in which said header and fingers are formed of wires.

4. A junction as defined in claim 1 in which said header is formed of metal sheet and said fingers are formed of wires.

5. A junction as defined in claim 1 in which said header and fingers are formed of integral plastic.

* * * * *